US010383378B1

(12) United States Patent
Ptah

(10) Patent No.: US 10,383,378 B1
(45) Date of Patent: Aug. 20, 2019

(54) THERAPEUTIC MASSAGE GLOVES

(71) Applicant: Daniel Ptah, Rock Hill, SC (US)

(72) Inventor: Daniel Ptah, Rock Hill, SC (US)

( * ) Notice: Subject to any disclaimer, the term of this patent is extended or adjusted under 35 U.S.C. 154(b) by 238 days.

(21) Appl. No.: 15/628,099

(22) Filed: Jun. 20, 2017

(51) Int. Cl.

| | |
|---|---|
| ***A61H 15/00*** | (2006.01) |
| ***A41D 19/00*** | (2006.01) |
| ***A61H 7/00*** | (2006.01) |
| *A61H 37/00* | (2006.01) |

(52) U.S. Cl.
CPC ..... *A41D 19/0024* (2013.01); *A61H 7/001* (2013.01); *A61H 7/007* (2013.01); *A41D 19/00* (2013.01); *A41D 2400/322* (2013.01); *A61H 37/00* (2013.01); *A61H 2015/0064* (2013.01); *A61H 2015/0071* (2013.01)

(58) Field of Classification Search
CPC ..... A41D 19/01594; A61H 2015/0064; A61H 2201/1635
See application file for complete search history.

(56) References Cited

U.S. PATENT DOCUMENTS

| | | | | |
|---|---|---|---|---|
| 1,161,719 | A | 11/1915 | Norton | |
| 2,837,745 | A * | 6/1958 | Nelson | A41D 19/01594 2/161.6 |
| 4,577,625 | A | 3/1986 | Lohati | |
| 6,401,252 | B1 | 6/2002 | Dean | |
| 6,669,657 | B1 | 12/2003 | Ongwela | |
| D530,017 | S | 10/2006 | Bondi | |
| 7,707,654 | B1 | 5/2010 | Spence | |
| 2002/0083508 | A1 | 7/2002 | Dean | |
| 2013/0172794 | A1 | 7/2013 | Tao | |
| 2014/0088473 | A1 | 3/2014 | Mastando | |
| 2016/0113834 | A1 * | 4/2016 | Bring | A61N 2/00 601/134 |
| 2016/0120243 | A1 * | 5/2016 | Matzel | A41D 19/0082 2/161.6 |

FOREIGN PATENT DOCUMENTS

| | | | |
|---|---|---|---|
| WO | 8400292 | A1 | 2/1984 |

* cited by examiner

*Primary Examiner* — Tajash D Patel

(57) ABSTRACT

The therapeutic massage gloves is a therapeutic device. The therapeutic massage gloves is adapted to be worn on a hand of a therapist. The therapeutic massage gloves is adapted for use with a patient or client. The therapeutic massage gloves is adapted for use in massage activities. The therapeutic massage gloves comprises a glove that further comprises a trank, a plurality of finger stalls, and a plurality of therapeutic devices. The plurality of finger stalls are attached to the trank. The plurality of therapeutic devices are attached to a location selected from the group consisting of the trank and the plurality of finger stalls. Each therapeutic device selected from the plurality of therapeutic devices is a tool that is used to knead a muscle during massage activities.

15 Claims, 6 Drawing Sheets

THERAPEUTIC MASSAGE GLOVES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical and veterinary science including physical therapy apparatus, more specifically, a device configured for use in therapeutic massage activities.

The anatomy of the human hand 200 is best understood by understanding the bones within the hand 200. The wrist 260 comprises 8 carpal bones that attach the fingers to the radius bone 261 and ulna bone 262 of the arm. Each finger is attached to the wrist 260 with a metacarpal bone. The thumb attaches to the wrist 260 with the proximal end of the first metacarpal 201 bone. The index finger attaches to the wrist 260 with the proximal end of the second metacarpal 202 bone. The middle finger attaches to the wrist 260 with the proximal end of the third metacarpal 203 bone. The ring finger attaches to the wrist 260 with the proximal end of the fourth metacarpal 204 bone. The little finger attaches to the wrist 260 with the proximal end of the fifth metacarpal 205 bone.

The thumb (First Finger 251) further comprises a first proximal phalange 211 and a first distal phalange 231. The bone structure of the thumb is completed by attaching the proximal end of the first proximal phalange 211 to the distal end of the first metacarpal 201 and attaching the proximal end of the first distal phalange 231 to the distal end of the first proximal phalange 211.

The index finger (Second Finger 252) further comprises a second proximal phalange 212, a second intermediate phalange 222, and a second distal phalange 232. The bone structure of the thumb is completed by attaching: 1) the proximal end of the second proximal phalange 212 to the distal end of the second metacarpal 202; 2) the proximal end of the second intermediate phalange 222 to the distal end of the second proximal phalange 212; and, 3) the proximal end of the second distal phalange 232 to the distal end of the second intermediate phalange 222.

The middle finger (Third Finger 253) further comprises a third proximal phalange 213, a third intermediate phalange 223, and a third distal phalange 233. The bone structure of the thumb is completed by attaching: 1) the proximal end of the third proximal phalange 213 to the distal end of the third metacarpal 203; 2) the proximal end of the third intermediate phalange 223 to the distal end of the third proximal phalange 213; and, 3) the proximal end of the third distal phalange 233 to the distal end of the third intermediate phalange 223.

The ring finger (Fourth Finger 254) further comprises a fourth proximal phalange 214, a fourth intermediate phalange 224, and a fourth distal phalange 234. The bone structure of the thumb is completed by attaching: 1) the proximal end of the fourth proximal phalange 214 to the distal end of the fourth metacarpal 204; 2) the proximal end of the fourth intermediate phalange 224 to the distal end of the fourth proximal phalange 214; and, 3) the proximal end of the fourth distal phalange 234 to the distal end of the fourth intermediate phalange 224.

The little finger (Fifth Finger 255) further comprises a fifth proximal phalange 215, a fifth intermediate phalange 225, and a fifth distal phalange 235. The bone structure of the thumb is completed by attaching: 1) the proximal end of the fifth proximal phalange 215 to the distal end of the fifth metacarpal 205; 2) the proximal end of the fifth intermediate phalange 225 to the distal end of the fifth proximal phalange 215; and, 3) the proximal end of the fifth distal phalange 235 to the distal end of the fifth intermediate phalange 225.

The first metacarpal 201 through the fifth metacarpal 205 are enclosed by what is referred to as the palm of the hand 200.

The human hand 200 of the left side of the body is a mirror image of the human hand 200 of the right side of the body. The orientation is used to define the front side 161 of the hand 200. Specifically, the left hand 200 and the right hand 200 can only be overlaid on top of each other when the front side 161 of the left hand 200 is touching the front side 161 of the right hand 200. The side of the hand 200 opposite to the front side 161 is referred to as the rear side 162.

Within this disclosure, when referring to the bones of a hand 200, this disclosure will refer to the end of the bone that is closest to the wrist 260 as the proximal end and the end of the bone that is furthest from the wrist 260 as the distal end. This is consistent with medical terminology. Further, this disclosure will identify specific locations on the hand 200 by referring to the bone of the hand 200 that is proximal to the location.

A glove is an item of apparel that covers a hand 200. The glove comprises five finger stalls into which the fingers of the hand 200 are inserted. Each finger stall is attached to a trank 102. The trank 102 is the portion of the glove that covers the palm of the hand 200. Typically: 1) the thumb from the first proximal phalange 211 to the first distal phalange 231 is inserted into the first finger stall 151; 2) the index finger from the second proximal phalange 212 to the second distal phalange 232 is inserted into the second finger stall 152; 3) the middle finger from the third proximal phalange 213 to the third distal phalange 233 is inserted into the third finger stall 153; 4) the ring finger from the fourth proximal phalange 214 to the fourth distal phalange 234 is inserted into the fourth finger stall 154; and, 5) the little finger from the fifth proximal phalange 215 to the fifth distal phalange 235 is inserted into the fifth finger stall 155. This disclosure will identify specific locations on a glove by referring to the bone of the hand 200 that is proximal to the location.

SUMMARY OF INVENTION

The therapeutic massage gloves is a therapeutic device. The therapeutic massage gloves is adapted to be worn on a hand of a therapist. The therapeutic massage gloves is adapted for use with a patient or anyone with the ability to massage themselves or others. The therapeutic massage gloves is adapted for use in massage activities. The therapeutic massage gloves comprises a glove that further comprises a trank, a plurality of finger stalls, and a plurality of therapeutic devices. The plurality of finger stalls are attached to the trank. The plurality of therapeutic devices are attached to a location selected from the group consisting of the trank and the plurality of finger stalls. Each therapeutic device selected from the plurality of therapeutic devices is a tool that is used to knead a muscle during massage activities.

These together with additional objects, features and advantages of the therapeutic massage gloves will be readily apparent to those of ordinary skill in the art upon reading the following detailed description of the presently preferred, but nonetheless illustrative, embodiments when taken in conjunction with the accompanying drawings.

In this respect, before explaining the current embodiments of the therapeutic massage gloves in detail, it is to be understood that the therapeutic massage gloves is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the therapeutic massage gloves.

It is therefore important that the claims be regarded as including such equivalent construction insofar as they do not depart from the spirit and scope of the therapeutic massage gloves. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
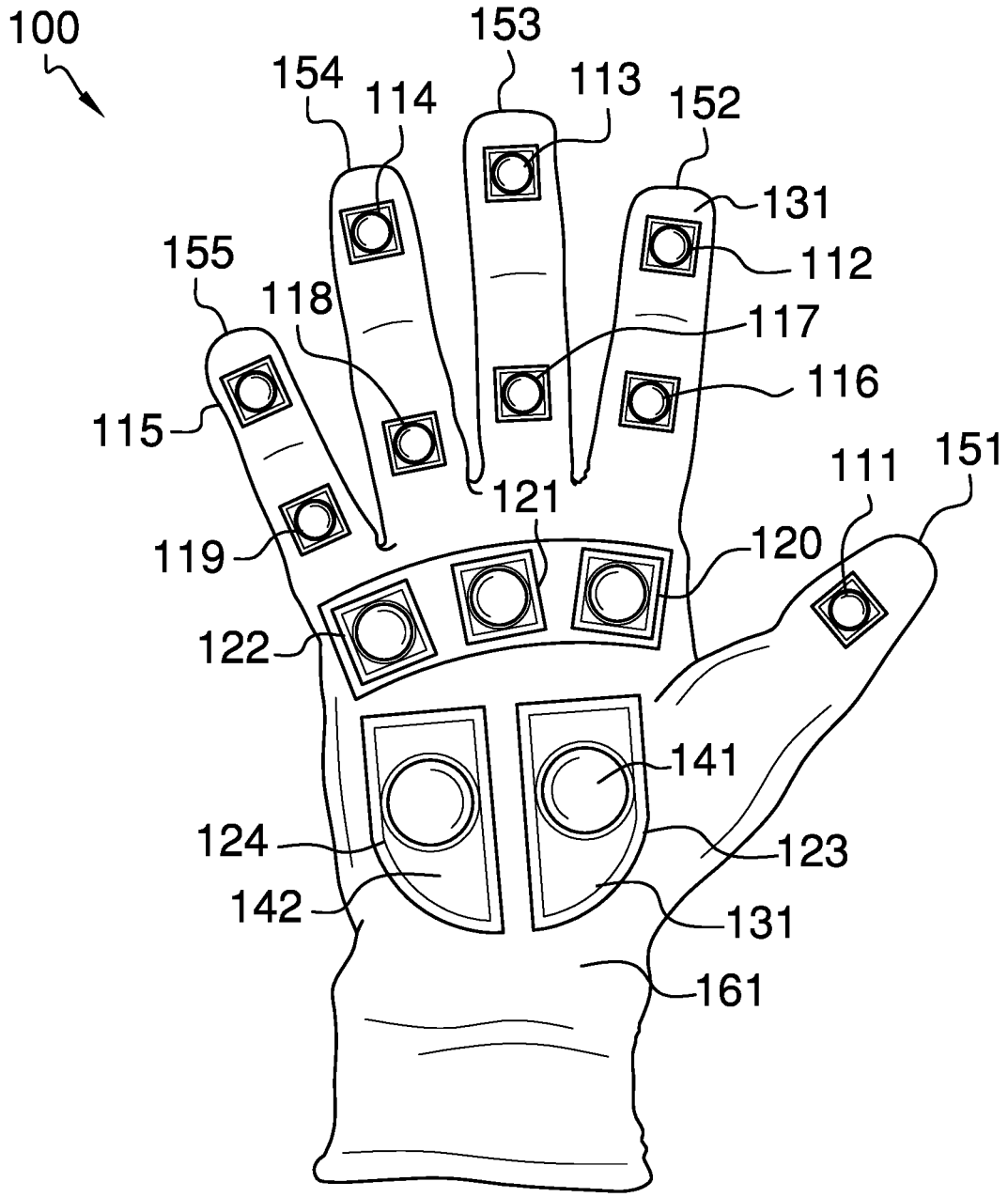
FIG. 1 is a front view of an embodiment of the disclosure.
Figure 2:
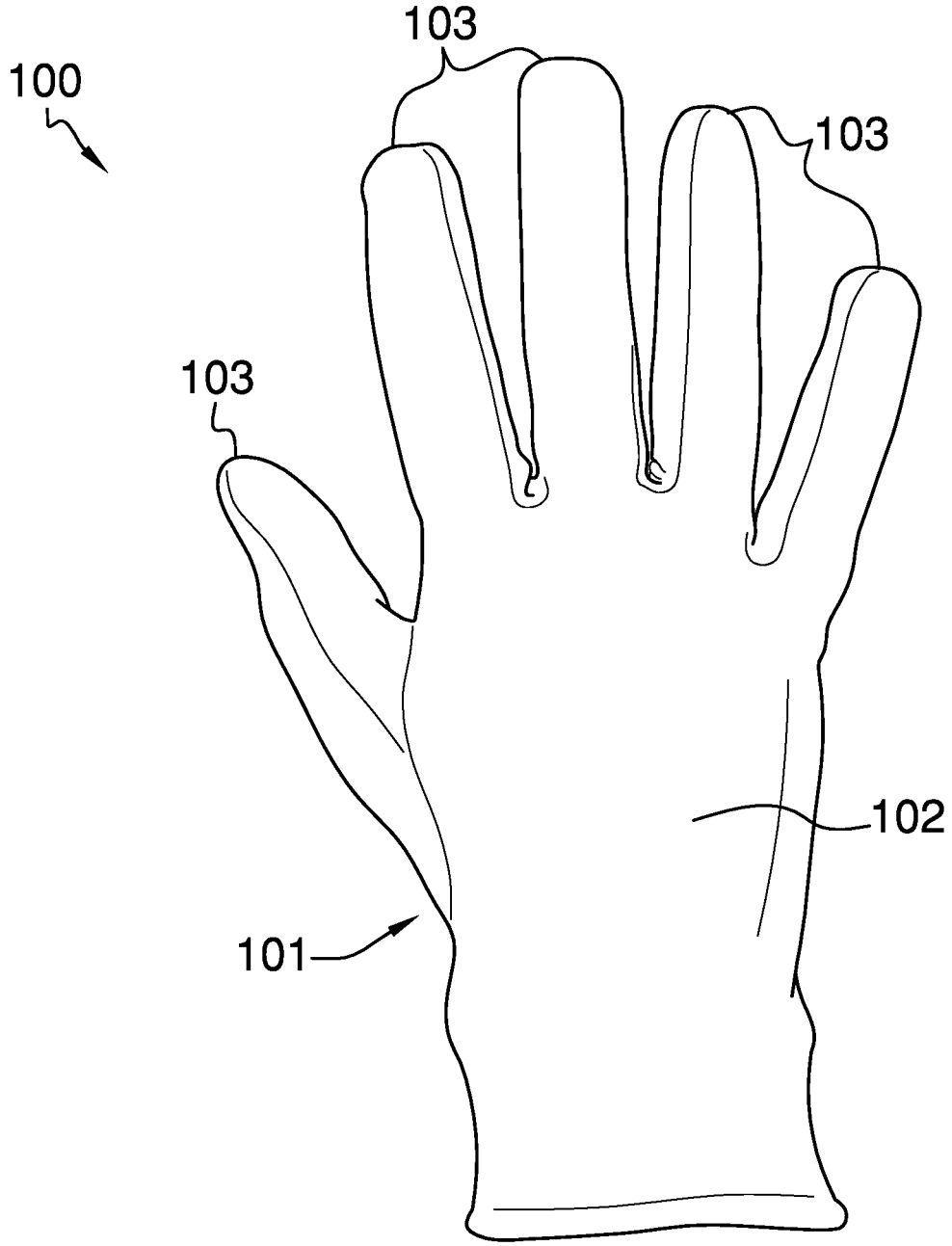
FIG. 2 is a rear view of an embodiment of the disclosure.
Figure 3:
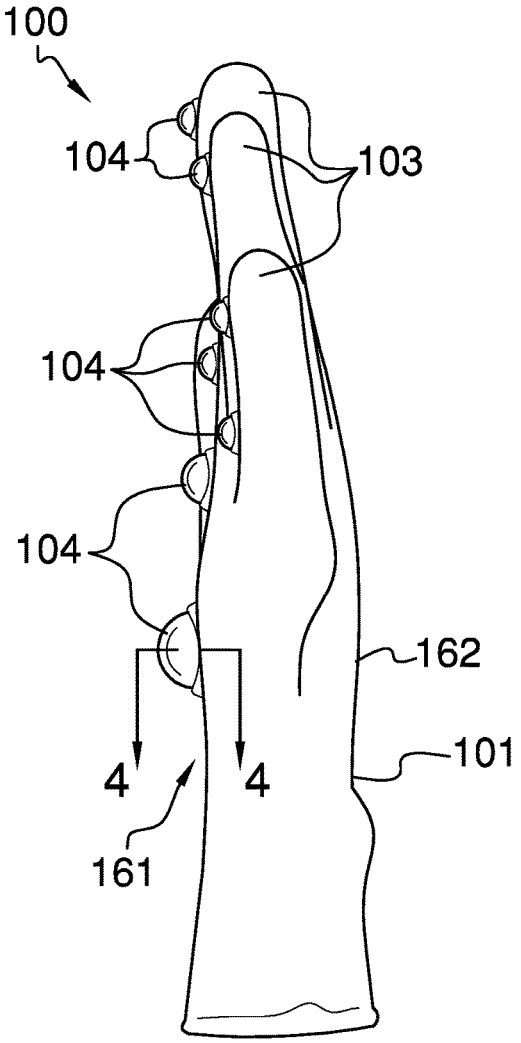
FIG. 3 is a side view of an embodiment of the disclosure.
Figure 4:
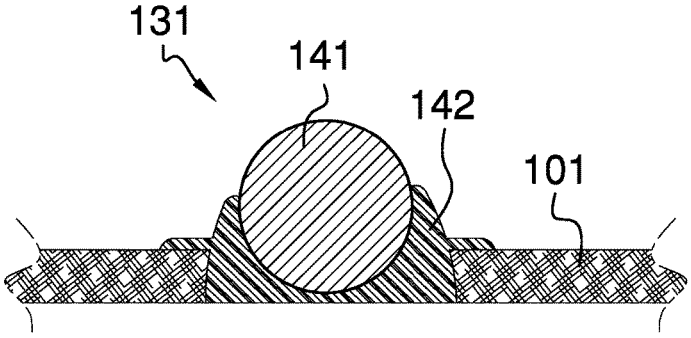
FIG. 4 is a cross-sectional view of an embodiment of the disclosure across 4-4 as shown in FIG. 3.
Figure 5:
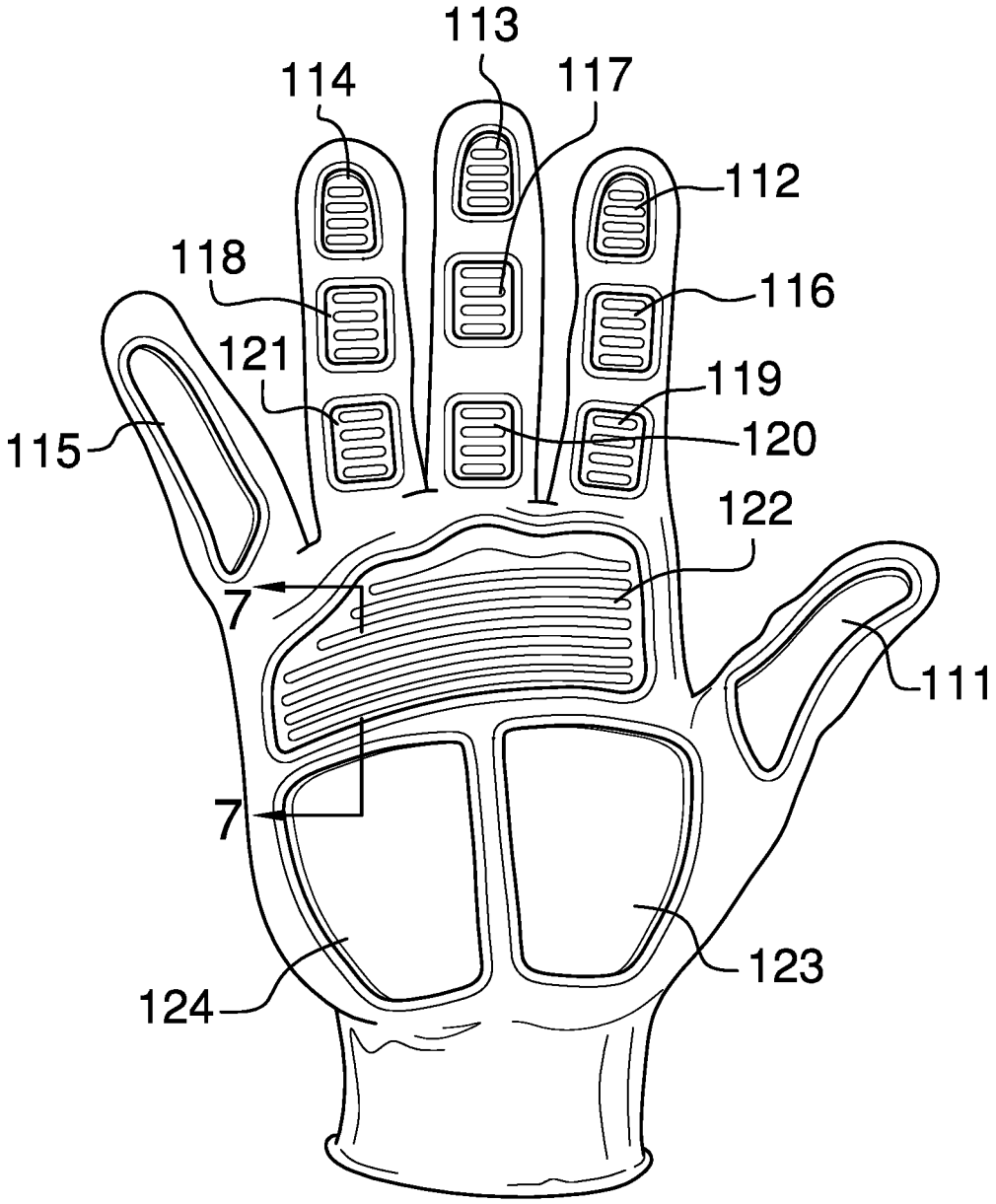
FIG. 5 is a front view of an embodiment of the disclosure.
Figure 6:
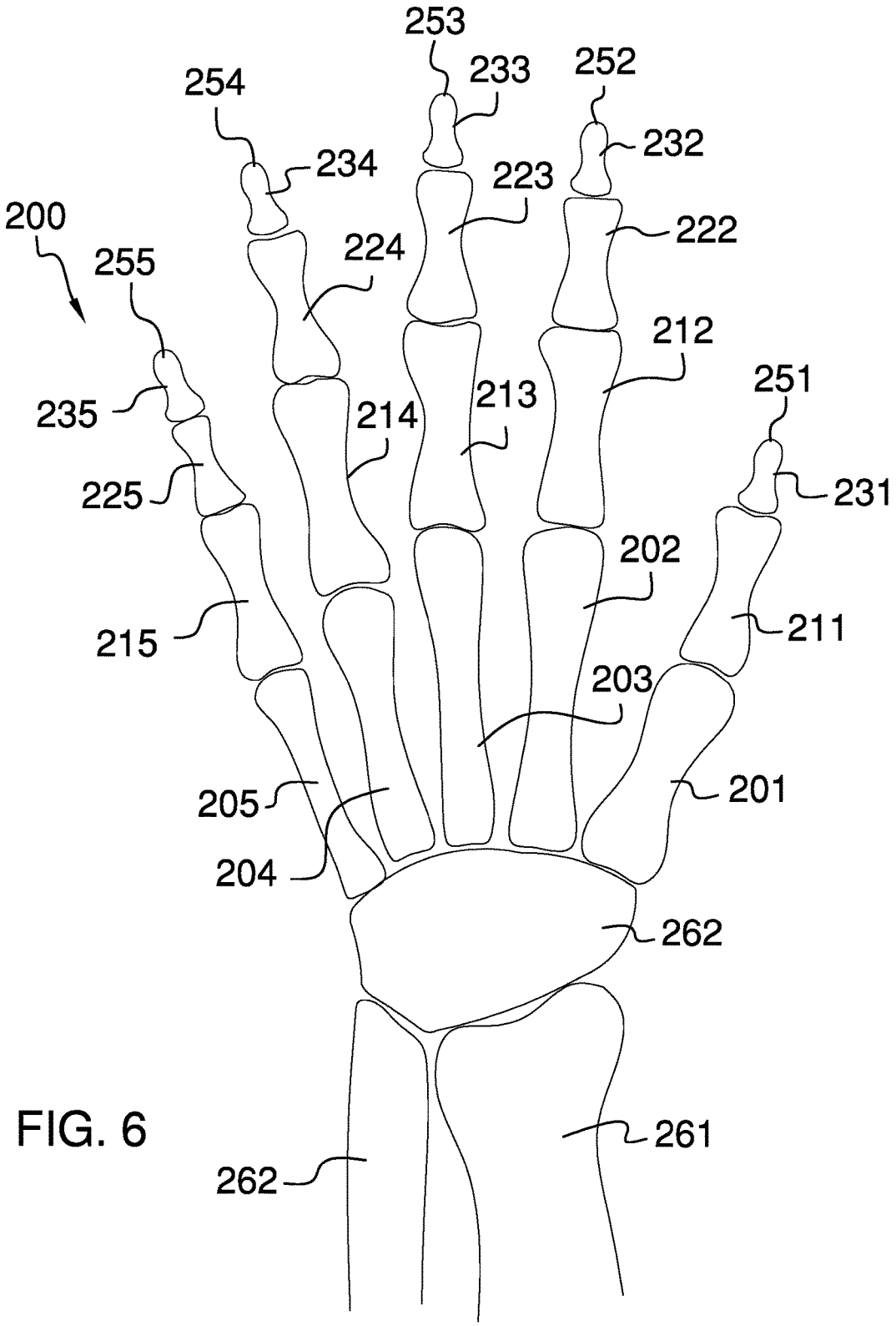
FIG. 6 is a detail view of an embodiment of the disclosure.
Figure 7:
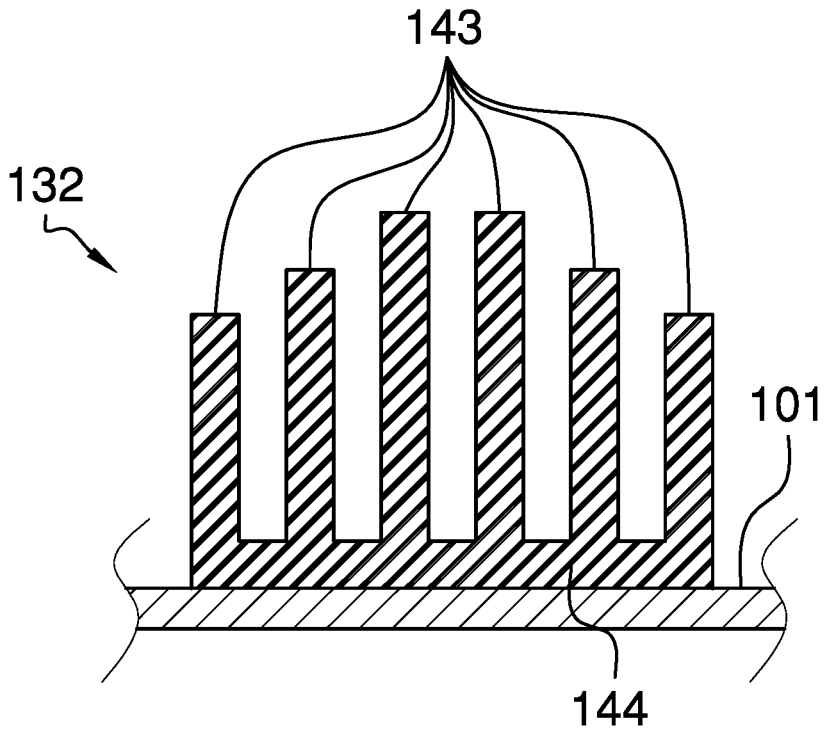
FIG. 7 is a cross-sectional view of an embodiment of the disclosure across 7-7 as shown in FIG. 5.

Detailed reference will now be made to one or more potential embodiments of the disclosure, which are illustrated in FIGS. 1 through 7.

The therapeutic massage gloves 100 (hereinafter invention) is a therapeutic device. The invention 100 is adapted to be worn on a hand 200 of a therapist. The invention 100 is adapted for use with a patient or client. The invention 100 is adapted for use in massage activities. The invention 100 comprises a glove 101 that further comprises a trank 102, a plurality of finger stalls 103, and a plurality of therapeutic devices 104. The plurality of finger stalls 103 are attached to the trank 102. The plurality of therapeutic devices 104 are attached to a location selected from the group consisting of the trank 102 and the plurality of finger stalls 103. Each therapeutic device selected from the plurality of therapeutic devices 104 is a tool that is used to knead and soothe a muscle during massage activities.

The glove 101 is an article of apparel that is worn over the hand 200. Within the disclosure the glove 101 is configured for use as a tool during therapeutic massage activities. The glove 101 is described in greater detail elsewhere in this disclosure. The use of a glove 101 is well known and documented within our society.

The trank 102 is the portion of the glove 101 that covers the palm of the hand 200. The trank 102 is described in greater detail elsewhere in this disclosure.

Each finger stall selected from the plurality of finger stalls 103 is a sleeve that attached to the trank 102 such that a finger of the hand 200 can be inserted in to the selected finger stall. Finger stalls are described in greater detail elsewhere in this disclosure. The plurality of finger stalls comprises a first finger stall 151, a second finger stall 152, a third finger stall 153, a fourth finger stall 154, and a fifth finger stall 155.

Each of the plurality of therapeutic devices 104 is a tool that is configured to manipulate a muscle in a manner consistent with the kneading motions typical during therapeutic massage activities. Each of the plurality of therapeutic devices 104 need not be identical. Each of the plurality of therapeutic devices 104 is selected from the group consisting of a track ball 131 and a bladed device 132. Any track ball 131 selected from the plurality of therapeutic devices 104 need not be identical to the other track balls 131 remaining within the plurality of therapeutic devices 104. Any bladed device 132 selected from the plurality of therapeutic devices 104 need not be identical to the other bladed devices 132 remaining within the plurality of therapeutic devices 104. The plurality of therapeutic devices 104 may contain a mixture of both track balls 131 and bladed devices 132 as required or desired.

The track ball 131 is a rotating spherical structure that is rolled over a muscle for the purpose of kneading the muscle. In the first potential embodiment of the disclosure each track ball 131 attaches to the front side 161 of the glove 101 using an adhesive. The track ball 131 comprises a roller 141 and a cup 142. The roller 141 is the spherical structure that is rolled over the muscle during therapeutic massage activities. The cup 142 is a container within which the roller 141 is contained. The cup 142 is a socket that attaches to the front side 161 of the glove 101 such that the working surface of the roller 141 is distal from the front side 161 of the glove 101. The cup 142 is sized to receive the roller 141.

Devices similar to the track ball 131 are well known in the computing arts as an interface device.

The bladed device 132 is a mechanical structure that reduces the surface area over which the forces used during therapeutic massage activities are concentrated. The bladed device 132 increases the pressure applied to the muscle being kneaded during therapeutic massage activities. The bladed device 132 comprises a plurality of blades 143 and a base plate 144. In the second potential embodiment of the disclosure each bladed device 132 attaches to the front side 161 of the glove 101 using an adhesive.

Each of the plurality of blades 143 is a semi-rigid structure that is formed in the shape of a rectangular plate. The semi-rigid structure of each of the plurality of blades 143 is elastic in nature. The base plate 144 is a rectangular block structure that is attached to the front side 161 of the glove 101. Each of the plurality of blades 143 attaches perpendicularly to the base plate 144 in the manner of the cantilever. Each of the plurality of blades 143 projects away from the front side 161 of the glove 101. During normal use of the invention 100, the free end of each of the plurality of blades 143 is placed in contact with the patient.

In the first potential embodiment of the disclosure, the plurality of therapeutic devices 104 comprises a first therapeutic device 111, a second therapeutic device 112, a third therapeutic device 113, a fourth therapeutic device 114, a fifth therapeutic device 115, a sixth therapeutic device 116, a seventh therapeutic device 117, an eighth therapeutic device 118, a ninth therapeutic device 119, a tenth therapeutic device 120, an eleventh therapeutic device 121, a twelfth therapeutic device 122, a thirteenth therapeutic device 123, and a fourteenth therapeutic device 124.

In the first potential embodiment of the disclosure, the first therapeutic device 111 is positioned on the front side 161 of the glove 101 directly over the first distal phalange 231. The second therapeutic device 112 is positioned on the front side 161 of the glove 101 directly over the second distal phalange 232. The third therapeutic device 113 is positioned on the front side 161 of the glove 101 directly over the third distal phalange 233. The fourth therapeutic device 114 is positioned on the front side 161 of the glove 101 directly over the fourth distal phalange 234. The fifth therapeutic device 115 is positioned on the front side 161 of the glove 101 directly over the fifth distal phalange 235.

The sixth therapeutic device 116 is positioned on the front side 161 of the glove 101 directly over the second proximal phalange 212. The seventh therapeutic device 117 is positioned on the front side 161 of the glove 101 directly over the third proximal phalange 213. The eighth therapeutic device 118 is positioned on the front side 161 of the glove 101 directly over the fourth proximal phalange 214. The ninth therapeutic device 119 is positioned on the front side 161 of the glove 101 directly over the fifth proximal phalange 215.

The tenth therapeutic device 120 is positioned on the front side 161 of the glove 101 directly over the space formed between the distal end of the second metacarpal 202 and the distal end of the third metacarpal 203. The eleventh therapeutic device 121 is positioned on the front side 161 of the glove 101 directly over the space formed between the distal end of the third metacarpal 203 and the distal end of the fourth metacarpal 204. The twelfth therapeutic device 122 is positioned on the front side 161 of the glove 101 directly over the space formed between the distal end of the fourth metacarpal 204 and the distal end of the fifth metacarpal 205.

The thirteenth therapeutic device 123 is positioned on the front side 161 of the glove 101 directly over both the proximal end of the second metacarpal 202 and the proximal end of the third metacarpal 203. The fourteenth therapeutic device 124 is positioned on the front side 161 of the glove 101 directly over both the proximal end of the fourth metacarpal 204 and the proximal end of the fifth metacarpal 205.

In the first potential embodiment of the disclosure, the first therapeutic device 111 is a track ball 131. The second therapeutic device 112 is a track ball 131. The third therapeutic device 113 is a track ball 131. The fourth therapeutic device 114 is a track ball 131. The fifth therapeutic device 115 is a track ball 131. The sixth therapeutic device 116 is a track ball 131. The seventh therapeutic device 117 is a track ball 131. The eighth therapeutic device 118 is a track ball 131. The ninth therapeutic device 119 is a track ball 131. The tenth therapeutic device 120 is a track ball 131. The eleventh therapeutic device 121 is a track ball 131. The twelfth therapeutic device 122 is a track ball 131. The thirteenth therapeutic device 123 is a track ball 131. The fourteenth therapeutic device 124 is a track ball 131.

In the second potential embodiment of the disclosure, the plurality of therapeutic devices 104 comprises a first therapeutic device 111, a second therapeutic device 112, a third therapeutic device 113, a fourth therapeutic device 114, a fifth therapeutic device 115, a sixth therapeutic device 116, a seventh therapeutic device 117, an eighth therapeutic device 118, a ninth therapeutic device 119, a tenth therapeutic device 120, an eleventh therapeutic device 121, a twelfth therapeutic device 122, a thirteenth therapeutic device 123, and a fourteenth therapeutic device 124.

In the second potential embodiment of the disclosure, the first therapeutic device 111 is positioned on the front side 161 of the glove 101 directly over the first distal phalange 231 and the first proximal phalange 211. The second therapeutic device 112 is positioned on the front side 161 of the glove 101 directly over the second distal phalange 232. The third therapeutic device 113 is positioned on the front side 161 of the glove 101 directly over the third distal phalange 233. The fourth therapeutic device 114 is positioned on the front side 161 of the glove 101 directly over the fourth distal phalange 234. The fifth therapeutic device 115 is positioned on the front side 161 of the glove 101 directly over the fifth distal phalange 235, the fifth intermediate phalange 225, and the fifth proximal phalange 215.

The sixth therapeutic device 116 is positioned on the front side 161 of the glove 101 directly over the second intermediate phalange 222. The seventh therapeutic device 117 is positioned on the front side 161 of the glove 101 directly over the third intermediate phalange 223. The eighth therapeutic device 118 is positioned on the front side 161 of the glove 101 directly over the fourth intermediate phalange 224.

The ninth therapeutic device 119 is positioned on the front side 161 of the glove 101 directly over the second proximal phalange 212. The tenth therapeutic device 120 is positioned on the front side 161 of the glove 101 directly over the third proximal phalange 213. The eleventh therapeutic device 121 is positioned on the front side 161 of the glove 101 directly over the fourth proximal phalange 214.

The twelfth therapeutic device 122 is positioned on the front side 161 of the glove 101 directly over the distal ends of each of the second metacarpal 202, the third metacarpal 203, the fourth metacarpal 204, and the fifth metacarpal 205.

The thirteenth therapeutic device 123 is positioned on the front side 161 of the glove 101 directly over the proximal ends of both of the second metacarpal 202 and the third metacarpal 203. The fourteenth therapeutic device 124 is positioned on the front side 161 of the glove 101 directly over the proximal ends of both of the fourth metacarpal 204 and the fifth metacarpal 205.

In the second potential embodiment of the disclosure, the first therapeutic device 111 is a bladed device 132. The second therapeutic device 112 is a bladed device 132. The third therapeutic device 113 is a bladed device 132. The fourth therapeutic device 114 is a bladed device 132. The fifth therapeutic device 115 is a bladed device 132. The sixth therapeutic device 116 is a bladed device 132. The seventh therapeutic device 117 is a bladed device 132. The eighth therapeutic device 118 is a bladed device 132. The ninth therapeutic device 119 is a bladed device 132. The tenth therapeutic device 120 is a bladed device 132. The eleventh therapeutic device 121 is a bladed device 132. The twelfth therapeutic device 122 is a bladed device 132. The thirteenth therapeutic device 123 is a bladed device 132. The fourteenth therapeutic device 124 is a bladed device 132.

To use the invention 100, the glove 101 is placed over the hand 200 such that: 1) the thumb (first finger) 251 is inserted into the first finger stall 151; 2) the index (second) finger 252 is inserted into the second finger stall 152; 3) the middle (third) finger 253 is inserted into the third finger stall 153; 4) the ring (fourth) finger 254 is inserted into the fourth finger stall 154; 5) the little (fifth) finger 255 is inserted into the fifth finger stall 155. In this configuration, the trank 102 will cover the palm of the hand 200. The therapist then proceeds to give a normal massage.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Elastic: As used in this disclosure, an elastic is a material or object that deforms when a force is applied to it and that is able to return to its relaxed shape after the force is removed. A material that exhibits these qualities is also referred to as an elastomeric material.

Finger Stall: As used in this disclosure, a finger stall refers to: 1) the roughly cylindrical structure associated with a glove into which a finger may be inserted; or, 2) a roughly cylindrical cover, commonly referred to as a finger cot, that is placed directly over a finger to cover the finger. A finger stall is also referred to as a fourchete.

Glove: As used in this disclosure, a glove is an item of apparel that covers a hand. The glove comprises five finger stalls into which the fingers of the hand are inserted. A glove is further defined with a palm side and a back side. The palm side is proximal to the palm of the hand. The back side is distal from the palm side.

Intermediate: As used in this disclosure, the term intermediate refers to a location that lies between a first object and a second object Interphalangeal Joint: As used in this disclosure, the interphalangeal joint refers to: 1) the joint that attaches a first selected phalange to a second selected phalange; or, 2) the joint that attaches a phalange to a metacarpal.

Kneading: As used in this disclosure, to knead refers to the folding, pressing a stretching of a collection of materials for the purpose of forming a uniform mass. The term kneading may further refer to the a hand motion similar to the motions used in kneading when that hand motion is applied to an object such as a person during massage activities.

Massage: As used in this disclosure, a massage is a therapeutic process wherein the muscles of the body are kneaded for the purpose of aiding circulation and relaxing the muscles.

Patient: As used in this disclosure, a patient is a person who is designated to receive a medical treatment, therapy or service. The term patient may be extended to an animal when used within the context of the animal receiving veterinary treatment or services Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Rectangular Block: As used in this disclosure, a rectangular block refers to a three dimensional structure comprising six rectangular surfaces formed at right angles. Within this disclosure, a rectangular block may further comprises rounded edges and corners.

Relaxed Shape: As used in this disclosure, a structure is considered to be in its relaxed state when no shear, strain, or torsional forces are being applied to the structure.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Therapeutic: As used in this disclosure, therapeutic is an adjective that refers to a medical, ameliorative, or hygienic substance, process, or procedure.

Tool: As used in this disclosure, a tool is a device, an apparatus, or an instrument that is used to carry out an activity, operation, or procedure.

Trank: As used in this disclosure, the trank refers to the portion of a glove that covers the palm and back of the hand.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A therapeutic hand wear comprising:

wherein the therapeutic hand wear comprises a glove;

wherein the glove is further defined with a front side;

wherein the glove comprises a trank, a plurality of finger stalls, and a plurality of therapeutic devices;

wherein the plurality of finger stalls are attached to the trank;

wherein the plurality of therapeutic devices are attached to a location selected from the group consisting of the trank and the plurality of finger stalls;

wherein the therapeutic hand wear is a therapeutic device;

wherein the therapeutic hand wear is adapted to be worn on a hand;

wherein the glove is an article of apparel that is adapted to be worn over the hand;

wherein the therapeutic hand wear is adapted for use in therapeutic massage activities;

wherein each of the plurality of therapeutic devices is a tool that is configured to manipulate a muscle in a manner consistent with the kneading motions typical during therapeutic massage activities;

wherein the trank is the portion of the glove that covers the palm of the hand;

wherein each finger stall selected from the plurality of finger stalls is a sleeve that attached to the trank such that a finger of the hand can be inserted in to the selected finger stall;

wherein each of the plurality of therapeutic devices is selected from the group consisting of a track ball and a bladed device;

wherein the track ball is a rotating spherical structure;

wherein the track ball attaches to the front side of the glove;

wherein the bladed device is a mechanical structure that reduces the surface area over which the forces used during therapeutic massage activities are concentrated;

wherein the bladed device attaches to the front side of the glove.

2. The therapeutic hand wear according to claim 1 wherein the track ball comprises a roller and a cup;

wherein the roller is contained within the cup;

wherein the roller is the spherical structure;

wherein the cup is a socket that is sized to receive the roller;

wherein the cup attaches to the front side of the glove.

3. The therapeutic hand wear according to claim 2 wherein the bladed device comprises a plurality of blades and a base plate;

wherein the plurality of blades are attached to the base plate;

wherein each of the plurality of blades is a semi-rigid structure;

wherein the semi-rigid structure of each of the plurality of blades is elastic in nature;

wherein each of the plurality of blades is shaped as a rectangular plate;

wherein the base plate is a rectangular block structure;

wherein the base plate attaches to the front side of the glove;

wherein each of the plurality of blades attaches perpendicularly to the base plate in the manner of the cantilever;

wherein each of the plurality of blades projects away from the front side of the glove.

4. The therapeutic hand wear according to claim 3 wherein the plurality of finger stalls comprises a first finger stall, a second finger stall, a third finger stall, a fourth finger stall, and a fifth finger stall;

wherein the glove is placed over the hand such that the first finger is inserted into the first finger stall;

wherein the glove is placed over the hand such that the second finger is inserted into the second finger stall;

wherein the glove is placed over the hand such that the third finger is inserted into the third finger stall;

wherein the glove is placed over the hand such that the fourth finger is inserted into the fourth finger stall;

wherein the glove is placed over the hand such that the fifth finger is inserted into the fifth finger stall.

5. The therapeutic hand wear according to claim 4 wherein the plurality of therapeutic devices comprises a first therapeutic device, a second therapeutic device, a third therapeutic device, a fourth therapeutic device, and a fifth therapeutic device, wherein the first therapeutic device is positioned on the front side of the glove directly over the first distal phalange;

wherein the second therapeutic device is positioned on the front side of the glove directly over the second distal phalange;

wherein the third therapeutic device is positioned on the front side of the glove directly over the third distal phalange;

wherein the fourth therapeutic device is positioned on the front side of the glove directly over the fourth distal phalange;

wherein the fifth therapeutic device is positioned on the front side of the glove directly over the fifth distal phalange.

6. The therapeutic hand wear according to claim 5 wherein the plurality of therapeutic devices comprises a sixth therapeutic device, a seventh therapeutic device, an eighth therapeutic device, and a ninth therapeutic device;

wherein the sixth therapeutic device is positioned on the front side of the glove directly over the second proximal phalange;

wherein the seventh therapeutic device is positioned on the front side of the glove directly over the third proximal phalange;

wherein the eighth therapeutic device is positioned on the front side of the glove directly over the fourth proximal phalange;

wherein the ninth therapeutic device is positioned on the front side of the glove directly over the fifth proximal phalange.

7. The therapeutic hand wear according to claim 6 wherein the plurality of therapeutic devices comprises a tenth therapeutic device, an eleventh therapeutic device, and a twelfth therapeutic device;

wherein the tenth therapeutic device is positioned on the front side of the glove directly over the space formed between the distal end of the second metacarpal and the distal end of the third metacarpal;

wherein the eleventh therapeutic device is positioned on the front side of the glove directly over the space formed between the distal end of the third metacarpal and the distal end of the fourth metacarpal;

wherein the twelfth therapeutic device is positioned on the front side of the glove directly over the space formed between the distal end of the fourth metacarpal and the distal end of the fifth metacarpal.

8. The therapeutic hand wear according to claim 7 wherein the plurality of therapeutic devices comprises a thirteenth therapeutic device, and a fourteenth therapeutic device;

wherein the thirteenth therapeutic device is positioned on the front side of the glove directly over both the proximal end of the second metacarpal and the proximal end of the third metacarpal;

wherein the fourteenth therapeutic device is positioned on the front side of the glove directly over both the proximal end of the fourth metacarpal and the proximal end of the fifth metacarpal.

9. The therapeutic hand wear according to claim 4 wherein the plurality of therapeutic devices comprises a first therapeutic device;

wherein the first therapeutic device is positioned on the front side of the glove directly over the first distal phalange and the first proximal phalange.

10. The therapeutic hand wear according to claim 9 wherein the plurality of therapeutic devices comprises a second therapeutic device, a third therapeutic device, and a fourth therapeutic device, wherein the second therapeutic device is positioned on the front side of the glove directly over the second distal phalange;

wherein the third therapeutic device is positioned on the front side of the glove directly over the third distal phalange;

wherein the fourth therapeutic device is positioned on the front side of the glove directly over the fourth distal phalange.

11. The therapeutic hand wear according to claim 10 wherein the plurality of therapeutic devices comprises a fifth therapeutic device;

wherein the fifth therapeutic device is positioned on the front side of the glove directly over the fifth distal phalange, the fifth intermediate phalange, and the fifth proximal phalange.

12. The therapeutic hand wear according to claim 11 wherein the plurality of therapeutic devices comprises a sixth therapeutic device, a seventh therapeutic device, and an eighth therapeutic device;

wherein the sixth therapeutic device is positioned on the front side of the glove directly over the second intermediate phalange;

wherein the seventh therapeutic device is positioned on the front side of the glove directly over the third intermediate phalange;

wherein the eighth therapeutic device is positioned on the front side of the glove directly over the fourth intermediate phalange.

13. The therapeutic hand wear according to claim 12 wherein the plurality of therapeutic devices comprises a ninth therapeutic device, a tenth therapeutic device, and an eleventh therapeutic device;

wherein the ninth therapeutic device is positioned on the front side of the glove directly over the second proximal phalange;

wherein the tenth therapeutic device is positioned on the front side of the glove directly over the third proximal phalange;

wherein the eleventh therapeutic device is positioned on the front side of the glove directly over the fourth proximal phalange.

14. The therapeutic hand wear according to claim 13 wherein the plurality of therapeutic devices comprises a twelfth therapeutic device, a thirteenth therapeutic device, and a fourteenth therapeutic device;

wherein the twelfth therapeutic device is positioned on the front side of the glove directly over the distal ends of each of the second metacarpal, the third metacarpal, the fourth metacarpal, and the fifth metacarpal.

15. The therapeutic hand wear according to claim 14 wherein the plurality of therapeutic devices comprises a thirteenth therapeutic device, and a fourteenth therapeutic device;

wherein the thirteenth therapeutic device is positioned on the front side of the glove directly over the proximal ends of both of the second metacarpal and the third metacarpal;

wherein the fourteenth therapeutic device is positioned on the front side of the glove directly over the proximal ends of both of the fourth metacarpal and the fifth metacarpal.

* * * * *